US006095852A

United States Patent [19]

Gregory, II

[11] Patent Number: 6,095,852

[45] Date of Patent: Aug. 1, 2000

[54] CONNECTOR BRACKET WIRE SHIELD WITH CONNECTOR RETENTION ARMS

[75] Inventor: Jonathan Mark Gregory, II, Ann Arbor, Mich.

[73] Assignee: Yazaki North America, Inc., Canton, Mich.

[21] Appl. No.: 09/213,881

[22] Filed: Dec. 17, 1998

[51] Int. Cl.[7] ..... H01R 13/60

[52] U.S. Cl. ..... 439/540.1; 439/466

[58] Field of Search ..... 439/466, 364, 439/468, 473, 456, 459, 247, 248, 540.1, 701

[56] References Cited

U.S. PATENT DOCUMENTS

| | | | |
|---|---|---|---|
| 5,071,374 | 12/1991 | Plocek et al. | 439/752 |
| 5,259,785 | 11/1993 | Inaba et al. | 439/466 |
| 5,282,760 | 2/1994 | Aimasso | 439/752 |
| 5,328,388 | 7/1994 | Fust et al. | 439/544 |
| 5,480,312 | 1/1996 | Watanabe et al. | 439/135 |
| 5,569,040 | 10/1996 | Sumida | 439/157 |
| 5,971,796 | 10/1999 | Duhr | 439/445 |

FOREIGN PATENT DOCUMENTS 5-69868 9/1993 Japan .

*Primary Examiner*—Gary F. Paumen
*Assistant Examiner*—Alexander Gilman
*Attorney, Agent, or Firm*—Young & Basile, P.C.

[57] ABSTRACT

A connector bracket for holding two or more multi-wire electrical connectors for mating engagement with a junction block or other electrical component has a wire shield which is attached to the bracket after the connectors are inserted therein. The wire shield has retention arms which contact rear surfaces of the connectors to prevent the connectors from being dislodged from their proper positions within the bracket during mating of the bracket with the junction block.

11 Claims, 3 Drawing Sheets

CONNECTOR BRACKET WIRE SHIELD WITH CONNECTOR RETENTION ARMS

FIELD OF THE INVENTION

This invention relates in general to a bracket for holding two or more multi-pin electrical wiring connectors such that engagement of the bracket with a junction block or other electrical component simultaneously mates the connectors with corresponding mating receptacles. More particularly, the invention relates to a wire shield which is secured to such a bracket to protect and route the wires which extend from the connectors.

BACKGROUND OF THE INVENTION

It is sometimes desirable to mate a plurality of multi-pin electrical wiring connectors with respective receptacles located close to one another on a junction block or other electrical component. In such situations, it is known to first insert the connectors into a bracket which holds the connectors in the proper relative positions to match the layout of the receptacles on the junction block. The bracket is then secured to the junction block to simultaneously mate each of the connectors with its respective receptacle. In effect, insertion of the connectors into the bracket combines the assembly into one large connector which is then secured to the junction block in a single operation.

It is also known to make the cavities of the bracket which receive the connectors slightly oversized, so that the connectors are held loosely therein and may move in a plane perpendicular to the direction of insertion into their mating receptacles. This floating retention of the connectors within the cavities allows the connectors to self-align with their respective receptacles as the bracket is secured to the junction block, thus allowing the connectors to simultaneously mate with their receptacles in spite of dimensional variations in the parts which may occur as a result of manufacturing tolerances.

In the past, the floating engagement between the connectors and bracket has made it possible for the connectors to be forced rearwardly out of their proper positions within their cavities. It is also possible for the connectors to tilt or rotate somewhat within their receptacles so that they will not properly engage their mating connectors when the bracket is fastened to the junction block. The connectors may become misaligned as they contact the receptacles when the bracket is inserted into connection with the junction block, or due to pulling on the wire harnesses during handling of the assembly prior to connection to the junction block.

It is also known to secure a wire shield to the bracket after the connectors are inserted into the cavities to protect the wires extending from the connectors against chaffing and other undesirable contact. The wire shield also aids in directing the wires toward one end of the bracket where they are gathered together into a bundle.

SUMMARY OF THE INVENTION

It is an object of this invention to provide a bracket and wire shield assembly for holding multiple floating connectors and which assures correct positioning of the connectors within the bracket while not interfering with the floating movement of the connectors.

It is a further object of this invention to provide a wire shield that may be easily assembled to a bracket without trapping or pinching wires extending from the connectors retained in the bracket.

In carrying out this invention in the illustrative embodiment thereof, a bracket receives a plurality of electrical connectors and a wire shield fits over the insertion end of the bracket to substantially cover and protect the wires extending from the connectors. Lock arms on the wire shield engage tabs on the bracket to secure the wire shield in place. All of the wires are routed along the length of the bracket and wire shield and exit through an opening at one end of the shield.

At least one retention arm extends from the wire shield so that it is parallel to the rear surface of the connectors when the shield is secured to the bracket and contacts the rear surface of two adjacent connectors. This contact serves to prevent the connectors from being forced rearwardly out of their cavities and from tilting out of proper axial alignment within their respective receptacles.

According to another feature of the invention, the retention arm extends across a portion of the width of the bracket, perpendicular to the direction in which the wires are routed, and along a line between the two connectors so that the retention arm contacts the connectors only along their adjacent edges. This configuration ensures that the arm does not interfere with the wires projecting from the connectors and allows the arm to be inserted beneath the wires as the wire shield is secured to the bracket.

In the preferred embodiment of the invention described and depicted herein, the bracket has four connector cavities disposed in pairs on either side of an attachment block. Two retention arms extend from the wire shield, one for each pair of cavities. The retention arms are formed integrally with the wire shield, and each comprises a flat plate for contacting the connectors and two generally L-shaped stiffeners having first legs extending along the edges of the plate and second legs extending up the side wall of the wire shield. The undersides of the plates are generally parallel to the rear surfaces of the connectors and to the plane of floating movement of the connectors within their cavities so as not to impede this movement. The retention arms do, however, prevent the connectors from being urged rearwardly out of the cavities and from tipping or rocking out of alignment with the insertion axis of the cavities.

DESCRIPTION OF THE PREFERRED EMBODIMENT

FIGS. 1–5 depict a bracket 12 and wire shield 14 according to the invention for holding four electrical connectors 16. The wire shield 14 snaps into engagement with the bracket 12 after the connectors 16 have been inserted into the bracket, and the assembly is subsequently secured to a junction block or other electrical component (not shown) to simultaneously mate each of the connectors with a receptacle on the junction block. The wire shield 14 covers and protects the wires 18 extending from the connectors 16 and, as will be more fully explained herein, ensures proper positioning of the connectors within the bracket 12.

Figure 5:
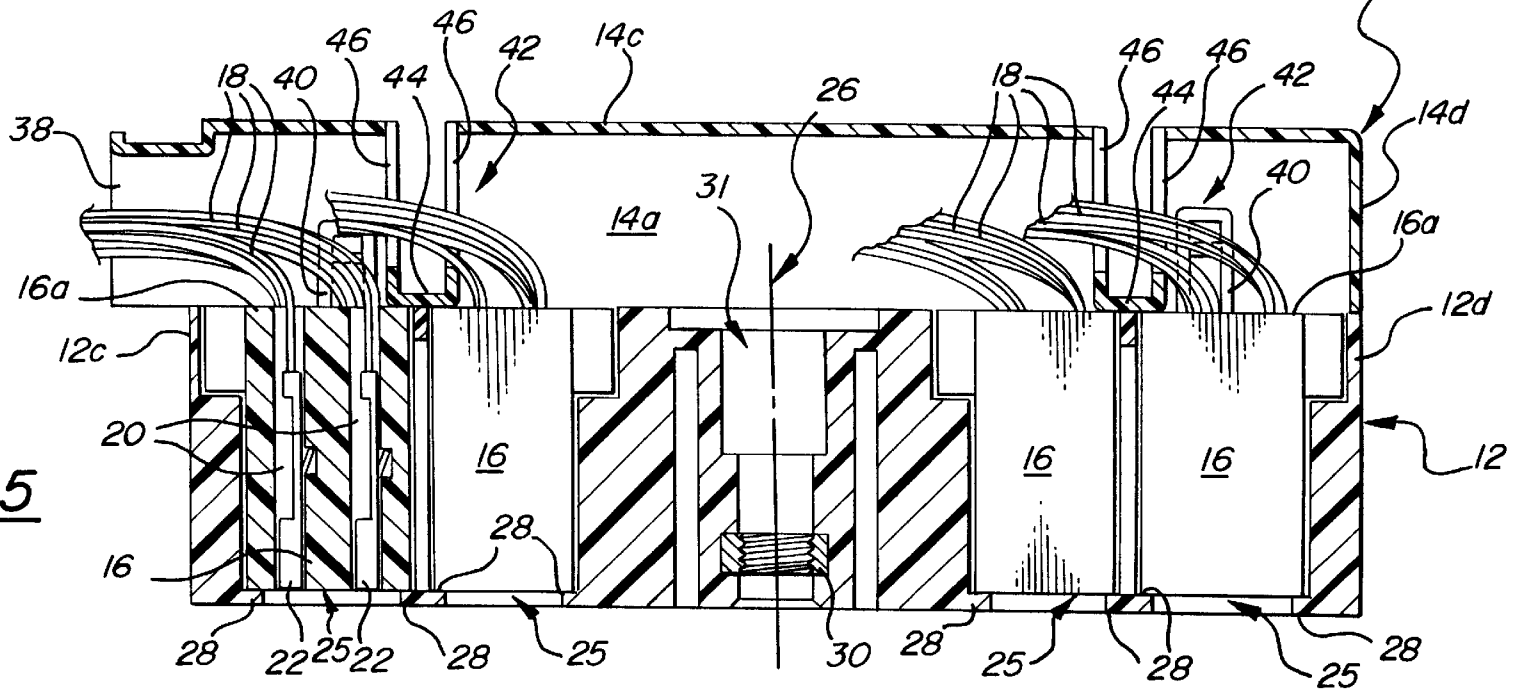
FIG. 5 is a section view taken along line 5—5 of FIG. 2.

The electrical connectors 16 are conventional in design, each having a plurality of internal chambers 20 for retaining female terminals 22 which are connected to wires 18 extending from a rear surface 16a of the connector (see FIG. 5). The connectors 16 have latching features 24 which, when the connectors are used in environments other than the present invention, retain the connectors in engagement with mating connectors (not shown).

The bracket 12 is preferably formed of thermoplastic material, such as polybutylteraphthalene (PBT), by an injection molding process. It is generally rectangular in shape, having an outer case defined by first and second sidewalls 12*a,b* and first and second end walls 12*c,d*. Numerous internal walls are molded integrally with the outer case to define four connector cavities 25 passing through the bracket 12 parallel to an insertion axis 26 between front and rear surfaces of the bracket. The connector cavities 25 are unobstructed at the open rear surface of the bracket 12, but stop walls 28 disposed adjacent the front surface of the bracket 12 extend a short distance inwardly in a plane perpendicular to the insertion axis 26 to partially block the cavities.

A hole 31 passes between the front and rear surfaces of the bracket 12 along the insertion axis 26 and a captive nut 30 is molded in place or otherwise retained within the hole (see FIG. 5). Several alignment holes 32 extend parallel to the insertion axis 26 and are open at the front surface of the bracket to receive locating pins (not shown) projecting from the junction block to aid in alignment of the bracket with the junction block during mating. Flexible latch tabs 34 extend rearwardly from the sidewalls of the bracket 12 and have pawls 36 (see FIG. 3) projecting from inner faces thereof.

The wire shield 14 is generally rectangular and sized to fit over the rear surface of the bracket 12. It is preferably formed of a thermoplastic material, such as PBT, by an injection molding process. The wire shield 14 has first and second sidewalls 14*a,b* and a domed top wall 14*c*. An end wall 14*d* closes off a first end of the wire shield 14, and a collar 38 extends from an open second end. U-shaped latch arms 40 are disposed on the sidewalls 14*a,b*, with adjacent portions of the sidewalls cut away to expose the arms.

First and second retention arms 42 project from the sidewall 14*a* and extend across approximately one-half of the width of the wire shield 14. Each arm 42 comprises a flat contact plate 44 disposed parallel to the open bottom of the shield 14 and two generally L-shaped stiffeners 46 having first legs extending along the edges of the plate and second legs extending up the side wall 14*a*. The retention arms 42 are preferably formed integrally with the wire shield 14, and molding windows 48 in the top surface of the wire shield 14 (see FIG. 2) allow formation of the retention arms 42 during injection molding.

Edge tabs 50 extend from the bottom edges of the sidewalls 14*a,b* at several locations. Molding windows 52 are also provided in the top surface of the wire shield 14 directly above the edge tabs 50 to permit their formation during injection molding.

The four connectors 16 are inserted into their respective cavities 25 from the open rear surface of the bracket and contact the stop walls 28 at the front surface of the bracket. The stop walls 28 engage the front ends of the connectors 16 only at points around their peripheries so as not to obstruct the openings of the terminal chambers 20. The cavities 25 are somewhat over-sized in relation to the connectors 16 so that the connectors are free to float several millimeters in any direction in the plane perpendicular to the insertion axis 26. The latching features 24 do not engage any portion of the bracket. The wires 18 extending from the connectors 16 are gathered together and routed toward the end of the bracket 12, as best seen in FIG. 5.

The wire shield 14 is then secured to the bracket 12 to cover the open rear surface. This is accomplished by sliding the shield 14 sideways toward the bracket 12 so that the retention arms 42 pass beneath the wires 18 (as seen in FIG. 5). As the perimeter walls of the shield and bracket are placed in registry, the edge tabs 50 are inserted inside of the bracket sidewalls 14*a,b*, and the shield is urged into connection with the bracket until the pawls 36 of latch tabs 34 snap into engagement with the latch arms 40 (see FIG. 3). The wires 18 pass between the retention arms 42 and the top wall 14*c* of the shield and exit the shield/bracket assembly through the collar 38. The wires 18 may be secured to the collar 38 by tape or other fastening means.

Figure 1:
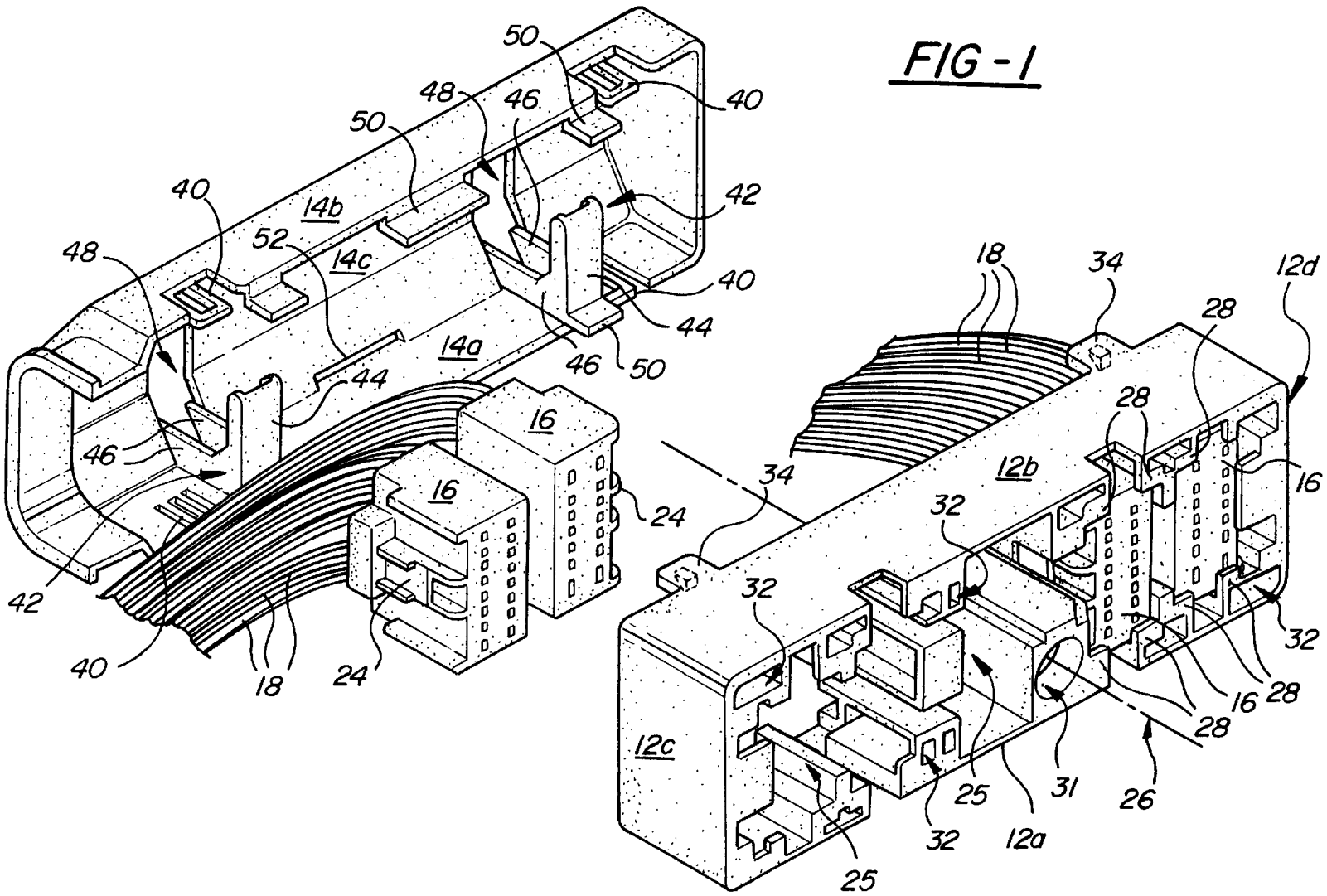
FIG. 1 is an exploded perspective view of a connector bracket and wire shield according to the present invention along with four electrical wiring connectors.
Figure 2:
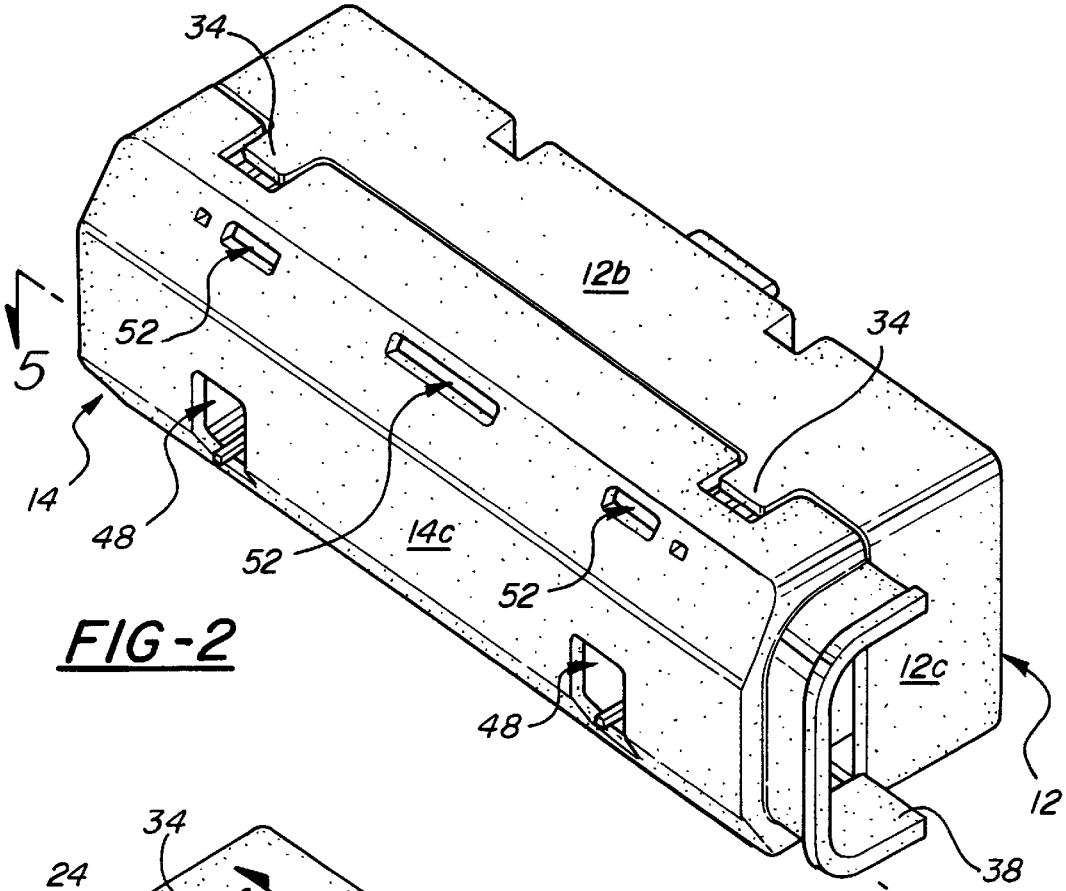
FIG. 2 is a perspective assembly view of the invention wire shield and bracket.
Figure 3:
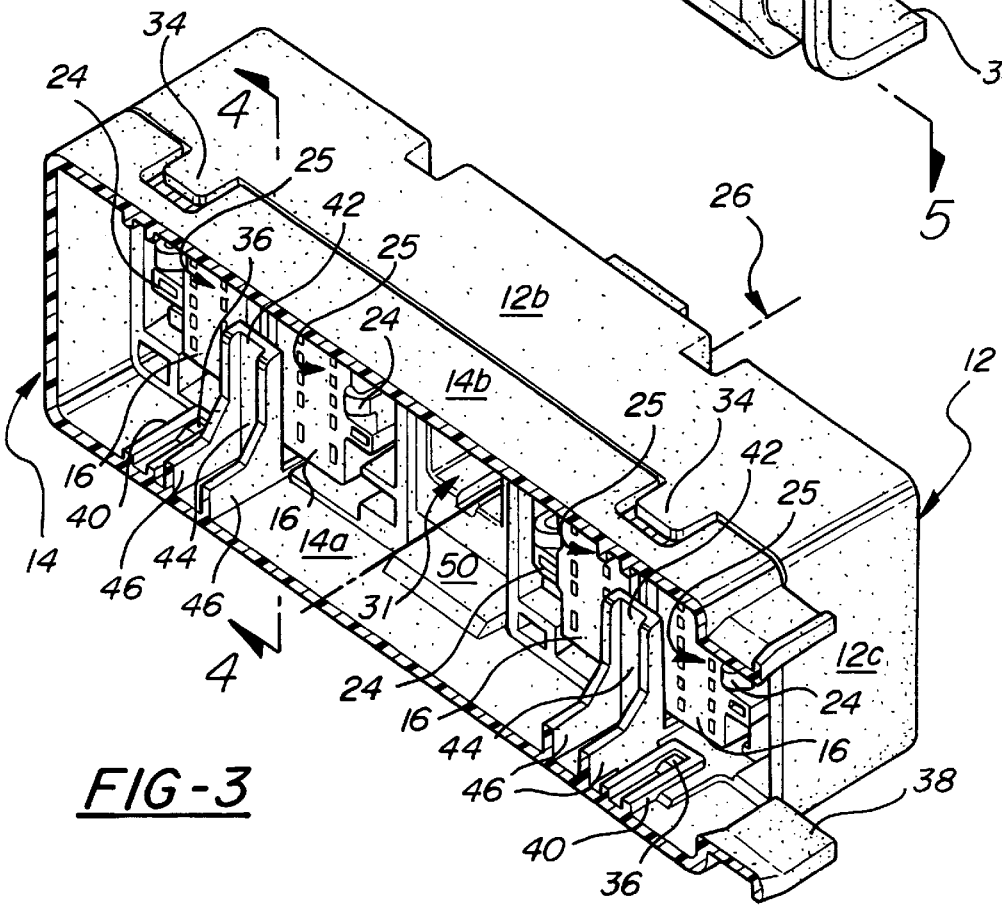
FIG. 3 is a cut-away view of FIG. 2.
Figure 4:
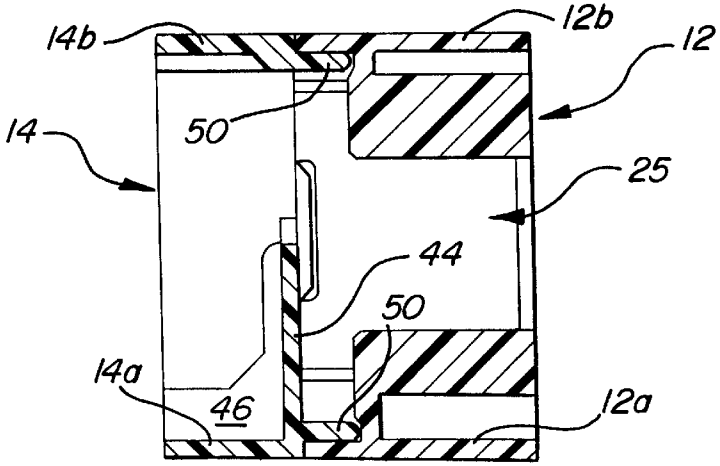
FIG. 4 is a section view taken along line 4—4 of FIG. 3.

As best seen in FIG. 3, each retention arm 42 extends along the line between two adjacent connectors 16 so that the arm contacts the connectors along their edges and does not obstruct the openings of the terminal chambers 20 nor interfere with the wires 18 projecting therefrom. The contact plates 44 of the retention arms are parallel to the rear surfaces of the connectors 16 so that the arms do not interfere with the floating movement of the connectors within their cavities 25, yet effectively prevent the connectors from moving rearwardly out of their cavities and from tipping or rotating out of proper alignment with the insertion axis 26.

The front surface of the bracket/shield/connector assembly is then placed in contact with the mating receptacle of the junction block or other component with which it is to be mated. The alignment holes 32 slide over alignment pins (not shown) on the mating component and a bolt (not shown) extending from the mating component is inserted into the central hole 31 to engage the captive nut 30. The bolt is tightened to draw the bracket/shield/connector assembly into full engagement with the mating component. As the bolt is tightened, the retention arms 42 ensure that the connectors 16 remain in proper alignment with the insertion axis 26 and prevent the connectors from being forced rearwardly out of their cavities 25 by contact with the mating terminals 22 and/or receptacles.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A wire shield for attachment to a bracket in which a plurality of electrical connectors are retained for floating movement, the wire shield fitting over an open surface of the bracket to cover wires extending from rear surfaces of the connectors and comprising:

at least one member extending from a wall of the shield at a position between a first and a second of the connectors, the at least one member contacting the rear surfaces of the connectors at adjacent edges of the first and second connectors to block movement of the connectors toward the open surface of the bracket.

2. A wire shield for attachment to a bracket in which a plurality of electrical connectors are retained for floating movement, the wire shield fitting over an open surface of the bracket to cover wires extending from rear surfaces of the connectors and comprising:

at least one retention element extending from a wall of the shield and having a first portion parallel to the rear surfaces of the connectors to contact the rear surfaces of the connectors to block movement of the connectors toward the open surface of the bracket, and a second portion including a first leg extending along an edge of the first portion and a second leg formed integrally with the wall, the second leg attaching the first leg to the wall.

3. A wire shield according to claim 1 wherein the at least one member is spaced from a top wall of the wire shield such that the wires may pass between the at least one member and the top wall when the wire shield is secured to the bracket.

4. A wire shield according to claim 1 wherein the at least one member extends along an axis perpendicular to the direction in which the wires are routed so that the at least one member may be inserted beneath the wires as the wire shield is secured to the bracket.

5. An assembly for holding a plurality of electrical connectors having wires extending from rear surfaces thereof, the assembly comprising:

a bracket having a plurality of cavities for receiving the connectors, the connectors insertable into respective cavities through an open surface of the bracket along an insertion axis and movable with respect to the bracket in a plane normal to the insertion axis; and a wire shield removably securable to the bracket to substantially cover the open surface and having means for blocking movement of two of the connectors out of their respective cavities toward the open surface, the movement blocking means projecting from a wall of the shield and including a contact part extending parallel to the rear surfaces of the connectors and positioned to contact edges of the two connectors.

6. An assembly according to claim 5 wherein the movement blocking means further includes a first leg extending parallel to the rear surfaces of the connectors and attached to the contact part, and a second leg formed integrally with the wall.

7. An assembly for holding a plurality of electrical connectors having wires extending from rear surfaces thereof, the assembly comprising:

a bracket having a plurality of cavities for receiving the connectors, the connectors insertable into respective cavities through an open surface of the bracket along an insertion axis and movable with respect to the bracket in a plane normal to the insertion axis; and a wire shield removably securable to the bracket to substantially cover the open surface and having at least one member for preventing movement of two adjacent connectors of the plurality along the insertion axis, the at least one member including a part for contacting the two adjacent connectors and means for joining the contacting part to a wall of the shield.

8. An assembly according to claim 7 wherein the joining means extends from the wall at a position between the two connectors so the contacting part contacts adjacent edges of the two connectors.

9. An assembly according to claim 7 wherein the at least one member is spaced from a top wall of the wire shield such that the wires may pass between the at least one member and the top wall when the wire shield is secured to the bracket.

10. An assembly according to claim 7 wherein the at least one member extends along an axis perpendicular to the direction in which the wires are routed so that the at least one member may be inserted beneath the wires as the wire shield is secured to the bracket.

11. An assembly according to claim 7 wherein the joining means are L-shaped stiffeners.

* * * * *